US010752467B2

(12) United States Patent
Pugh et al.

(10) Patent No.: US 10,752,467 B2
(45) Date of Patent: Aug. 25, 2020

(54) IN OR RELATING TO STAIRLIFTS

(71) Applicant: Stannah Stairlifts Limited, Hampshire (GB)

(72) Inventors: Gavin Scott Pugh, Farnham Surrey (GB); Paul Alexander Cook, Shrewton Wiltshire (GB)

(73) Assignee: Stannah Stairlifts Limited, Hampshire (GB)

( * ) Notice: Subject to any disclaimer, the term of this patent is extended or adjusted under 35 U.S.C. 154(b) by 382 days.

(21) Appl. No.: 15/563,272

(22) PCT Filed: Mar. 29, 2016

(86) PCT No.: PCT/GB2016/050867
§ 371 (c)(1),
(2) Date: Sep. 29, 2017

(87) PCT Pub. No.: WO2016/156822
PCT Pub. Date: Oct. 6, 2016

(65) Prior Publication Data

US 2018/0072537 A1 Mar. 15, 2018

(30) Foreign Application Priority Data

Mar. 30, 2015 (GB) ..... 1505467.9

(51) Int. Cl.
*B66B 9/08* (2006.01)

(52) U.S. Cl.
CPC ..... *B66B 9/0807* (2013.01); *B66B 9/08* (2013.01); *B66B 9/0853* (2013.01)

(58) Field of Classification Search
CPC ..... B66B 9/0807; B66B 9/08; B66B 9/0853; B66B 9/0838
See application file for complete search history.

(56) References Cited

U.S. PATENT DOCUMENTS

2003/0222607 A1* 12/2003 Simizu ..... A01D 34/006 318/139
2008/0128213 A1 6/2008 Harris
2013/0231814 A1* 9/2013 Sarokhan ..... B25J 9/1694 701/22
2013/0282174 A1* 10/2013 Xi ..... B25J 9/1682 700/248
2014/0299416 A1* 10/2014 Jakes ..... B66B 9/0838 187/201

FOREIGN PATENT DOCUMENTS

CN 201647771 U 11/2010
CN 102259780 A 11/2011
EP 0738232 A1 10/1996
EP 1772412 A1 * 4/2007 ..... B66B 9/0838
EP 2216284 A1 8/2010
WO 2014098574 A1 6/2014

* cited by examiner

*Primary Examiner* — Thomas C Lee
*Assistant Examiner* — Anzuman Sharmin
(74) *Attorney, Agent, or Firm* — Dinsmore & Shohl LLP

(57) ABSTRACT

The invention provides a method and apparatus for continuously adjusting the speed of a stairlift in response to a number of operating parameters such as battery voltage and motor current draw. The method preferably further includes monitoring the speed of a reference point on a stairlift chair and comparing this with a maximum permissible speed.

11 Claims, 4 Drawing Sheets

IN OR RELATING TO STAIRLIFTS

CROSS-REFERENCE TO RELATED APPLICATIONS

This application is the U.S. National Phase of PCT/GB2016/050867 filed Mar. 29, 2016, which claims priority of United Kingdom Patent Application 1505467.9 filed Mar. 30, 2015.

FIELD OF THE INVENTION

This invention relates to stairlifts and, in particular, to a method of and/or system for controlling the speed of a stairlift.

BACKGROUND

Stairlifts typically comprise a rail following the contour of a staircase; a carriage mounted to move along the rail; and a chair mounted on the carriage, upon which the stairlift user sits during movement of the carriage along the rail. The rail of a curved stairlift will typically include bends in a vertical plane (called transition bends) and bends in a horizontal plane (called inside/outside bends). The rail may also include bends that combine vertical and horizontal elements (called helical bends).

The speed of a stairlift is limited, by regulation. Under EU regulations stairlift speed is limited to a maximum of 0.15 m/s but this limit may vary in other jurisdictions. The reference point at which speed is measured is a point on the surface of the stairlift chair, at a position forward of the rear edge.

In the case of curved stairlifts, when the carriage is moving through a negative transition bend (a bend in which the angle of inclination reduces in the uphill direction) the speed of the reference point on the chair will accelerate relative to the carriage. Similarly, as will be described in greater detail below, when the carriage is moving through certain types of inside/outside bend, the reference point on the chair will typically proscribe a greater arc than the arc through which the carriage is moving and, accordingly, the reference point will accelerate relative to the carriage.

To ensure that the speed at the reference point does not exceed the prescribed upper limit, the stairlift carriage is typically slowed as it moves through bends. The changes of speed may be effected by placing switches along the rail, each switch serving to trigger a speed change in the carriage as the carriage moves past the switch. One alternative is to 'map' the rail in the broad manner described in our European Patent 0 738 232. In this case, the positions on the rail at which the carriage should be slowed or accelerated, are stored in an electronic memory. The position of the carriage on the rail is then monitored and the carriage speed then adjusted to that which is appropriate for the position on the rail.

Further factors may influence the speed of a stairlift, two being battery voltage and motor current draw. These are typically limited, empirically, to avoid damaging the batteries, it being recognized that demand on the batteries will vary according to factors such as passenger weight, carriage speed, initial state of charge of the battery, whether the carriage is moving up the rail or down the rail, and whether the carriage is moving through a transition bend necessitating operation of a levelling motor to maintain the chair level.

In order to accommodate these various factors, the speed of the stairlift is set somewhat arbitrarily, and based on experience, to ensure not only that the maximum permissible speed is not exceeded but also that battery voltage and current draw are maintained within limits. Invariably this means that the total time taken for the carriage to travel between the ends of the rail is longer than is necessary, and than is possible.

It is an object of the present invention to provide a method of controlling the speed of a stairlift, and/or a stairlift so controlled, which goes at least some way to addressing the problems identified above; or which at least offers a novel and useful choice.

SUMMARY OF THE INVENTION

Accordingly, in one aspect, the invention provides a method of controlling the speed of a stairlift, the stairlift having:

- a rail having at least one bend therein;
- a carriage mounted on said rail;
- a electric carriage motor operable to move said carriage along said rail;
- at least one battery to power said electric carriage motor; and
- a chair mounted on said carriage, said method including

- i) generating a first signal representative of current drawn by said carriage drive motor;
- ii) generating a second signal representative of a voltage level in said at least one battery or the power draw from said battery; and using said first and second signals as controls over the speed of said electric carriage motor.

Preferably said method further includes generating one or more third signals representative of the speed of a reference point on said chair, said one or more third signals being combined with said first and second signals as controls over the speed of said carriage drive motor.

Preferably said carriage is rotatable with respect to said chair, said method including generating a signal representative of the relative angular velocity between said carriage and said chair as said carriage moves through a transition bend in said rail.

Preferably said method further includes comparing said relative angular velocity with the speed of said carriage drive motor and, if necessary, adjusting the speed of said carriage drive motor to ensure said chair is maintained substantially level.

Preferably said method includes generating a signal representative of the angular velocity of said carriage as said carriage moves through a horizontal bend in said rail.

Preferably measurement of the rotational velocities of said carriage are effected using one more gyroscopes mounted in or on said carriage and/or said chair.

Preferably signals from said one or more gyroscopes are processed to establish the speed of said reference point on said chair.

Preferably said method further comprises adjusting the speed of said carriage pre-emptively having regard to the position of said carriage on said rail.

Preferably said method comprises learning and storing in a memory, acceptable speed changes at various positions on said rail.

In a second aspect the invention provides a stairlift, including:

- a rail having at least one bend therein;
- a carriage mounted on said rail;

an electric carriage motor operable to move said carriage along said rail;

at least one battery to power said electric carriage drive motor; and a chair mounted on said carriage;

said stairlift further including a speed control facility configured to i) generate a first signal representative of current drawn by said electric carriage drive motor, ii) generate a second signal representative of a voltage level in said at least battery or the power draw from said battery; and to apply said first and second signals as controls over the speed of said carriage motor.

Preferably said speed control facility is further configured to generate one or more third signals representative of the speed of a reference point on said chair, and to apply said one or more third signals, along with said first and second signals as controls over the speed of said carriage motor.

Preferably said speed control facility includes one or more gyroscopes mounted on or in said carriage and/or said chair to generate said one or more first signals.

Preferably said speed control facility includes a 3-axis gyroscope mounted in said carriage.

In a third aspect the invention provides a stairlift when controlled according to the method set forth above Many variations in the way the invention may be performed will present themselves to those skilled in the art upon reading the following description.

The description which follows should not be regarded as limiting but rather, as an illustration only of one manner of performing the invention. Where possible any element or component should be taken as including any or all equivalents thereof whether or not specifically mentioned.

BRIEF DESCRIPTION OF THE DRAWINGS

One form of the invention will now be described with reference to the accompanying drawings in which.

DESCRIPTION OF WORKING EMBODIMENTS

Figure 1:
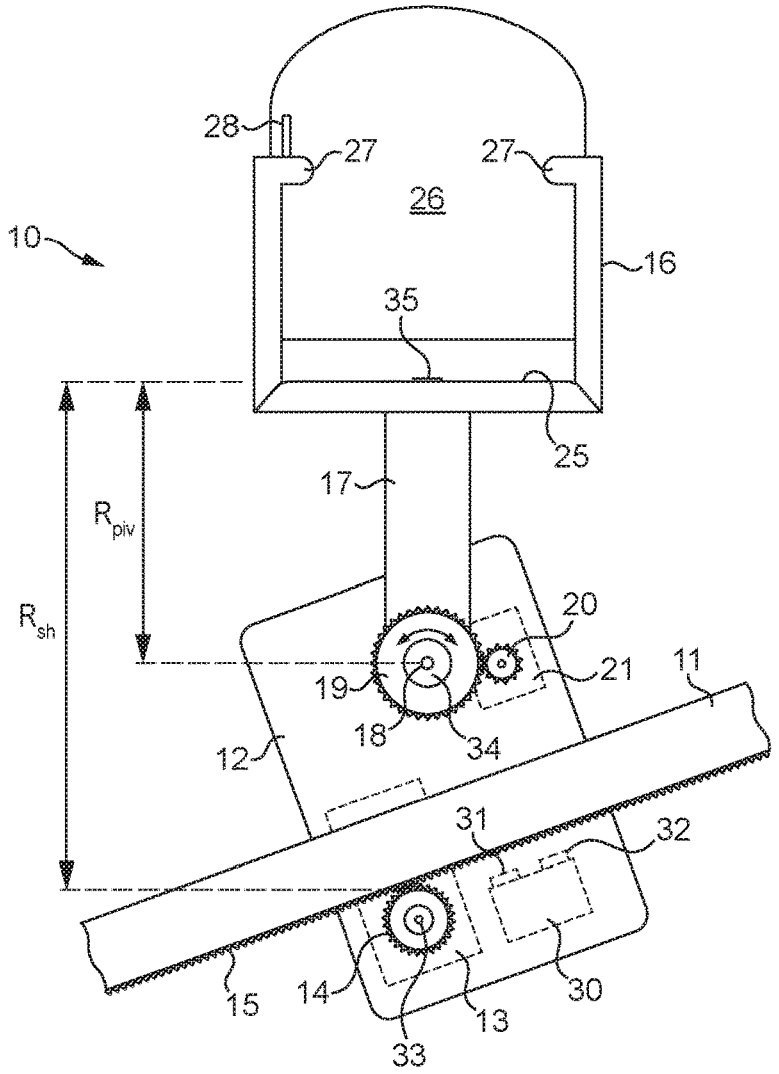
FIG. 1: shows a diagrammatic elevational view of a stairlift installation to which the invention may be applied.
Figure 2:
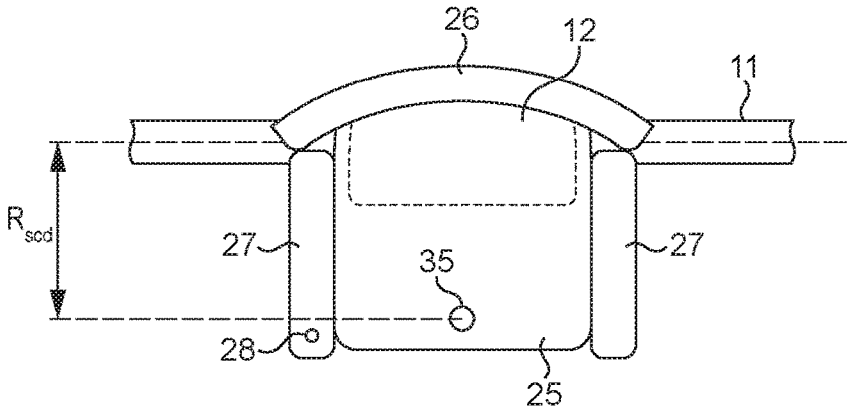
FIG. 2: shows a plan view of a stairlift carriage and chair mounted on a section of rail.

Referring firstly to FIGS. 1 and 2, the invention provides a method for controlling the speed of a stairlift 10; and a stairlift including a speed control facility. As is typical, the stairlift 10 includes a rail 11 that extends between adjacent levels in a building (not shown), and a carriage 12 mounted on the rail for movement along the rail. The carriage 12 includes a carriage drive motor 13 to displace the carriage up and down the rail 11, a pinion 14 mounted on the output of the motor meshing with a drive rack 15 extending along the underside of the rail 11. Those skilled in the art will appreciate that other drive arrangements could be used, the precise drive arrangement not forming part of this invention.

Mounted on, and extending above, the carriage 12 is a chair 16. As is well known in the art, the chair is mounted in such a manner that, when the carriage 12 moves through a transition bend in the rail, the chair remains horizontal. In some stairlifts, the chair and carriage are rotated as a unit with respect to the rail but, in the embodiment described herein, the chair is fixed to the upper end of arm 17, the lower end of arm 17 being pivotally mounted to the carriage along axis 18. A levelling gear 19 is fixed to the arm about axis 18, the gear 19 meshing with pinion 20 mounted on the output of a levelling motor 21. Thus, as the carriage 12 moves through transition bends in the rail 11 (later described with reference to FIG. 3 below), the relative orientation between the carriage and the chair is altered by operation of the motor 21 to maintain the chair substantially level.

In the form shown the chair 16 comprises a seat surface 25, a backrest 26, and spaced armrests 27. A user-operated control 28 is mounted on one of the armrests to allow a user seated in the chair to control the movement of the carriage along the rail. Although not shown for reasons of clarity, the chair will also typically include a footrest to support the user's feet during operation of the stairlift.

Control of the carriage drive motor 13 and the levelling motor 21 is effected by an electronic control unit (ECU) 30 mounted within the carriage. The ECU 30 receives inputs from the hand control 28 as well as from various sensors mounted on the carriage 12 and/or the chair 16 to ensure appropriate operation of the levelling motor 21 to maintain the seat 25 level at all times. These sensors preferably include a gyroscope 31 mounted in the carriage and arranged to provide an output representative of the speed of rotation of the carriage in transition bends (roll). The gyroscope 31 may also have the functionality to measure the speed of rotation as the carriage moves through horizontal bends (yaw), this being so if the gyroscope is a 3-axis gyroscope. However the speed of rotation in yaw could also be measured using a gyroscope mounted on the chair. The sensors further include a carriage accelerometer 32, a carriage encoder 33 operable to monitor the rotation of the drive pinion 14, and a chair encoder 34 operable to monitor the rotation of the chair leveling gear 19.

Those skilled in the art will recognize that means of measuring rates of angular rotation other than gyroscopes could be used in reducing the invention to practice without departing from the scope of the invention.

The present invention describes a method and/or system to improve the overall speed at which a stairlift carriage moves between the ends of the stairlift rail. This will invariably, though not necessarily, require monitoring of the maximum overall speed of the stairlift chair to ensure that the permitted maximum speed is not exceeded. One method of monitoring the speed of a reference point on the chair is therefore described.

As stated above, the maximum allowable speed of a stairlift is regulated. European Standard EN 81-40:2008 (E) establishes the position of a speed reference point indicated by 35 in the drawings. This point is located on the longitudinal centerline of the seat 25, 250 mm forward of a vertical line down through the forward face of the backrest 26. The standard prescribes that the speed of the reference point 35 shall not exceed 0.15 m/s in any direction. In other jurisdictions the speed limit may be some other figure.

Figure 3:
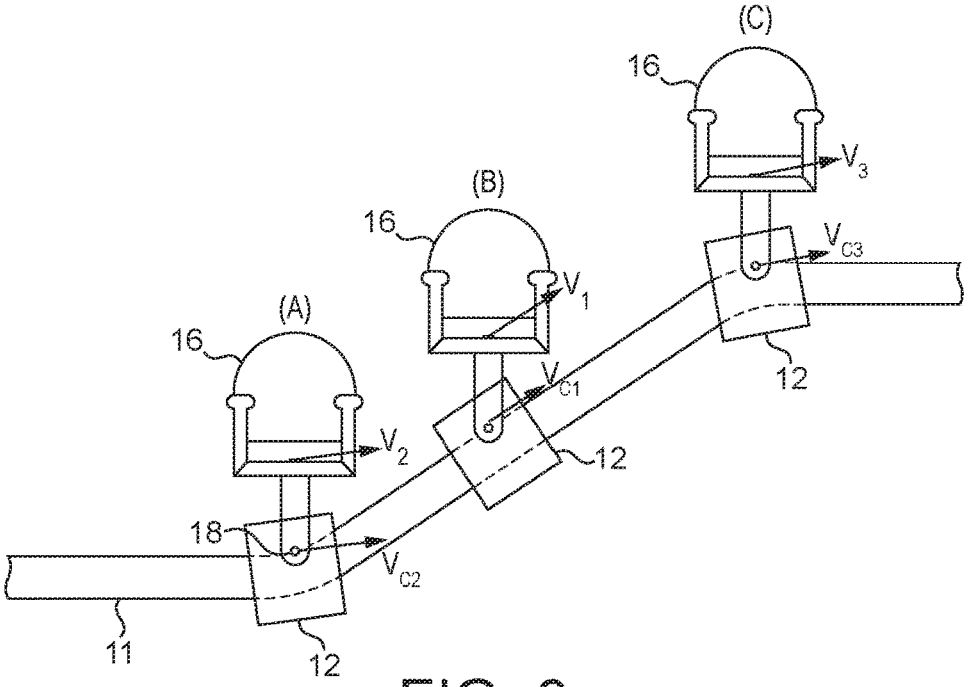
FIG. 3: shows a diagrammatical elevational view of part of a stairlift rail, and a carriage at different positions on that rail.
Figure 4:
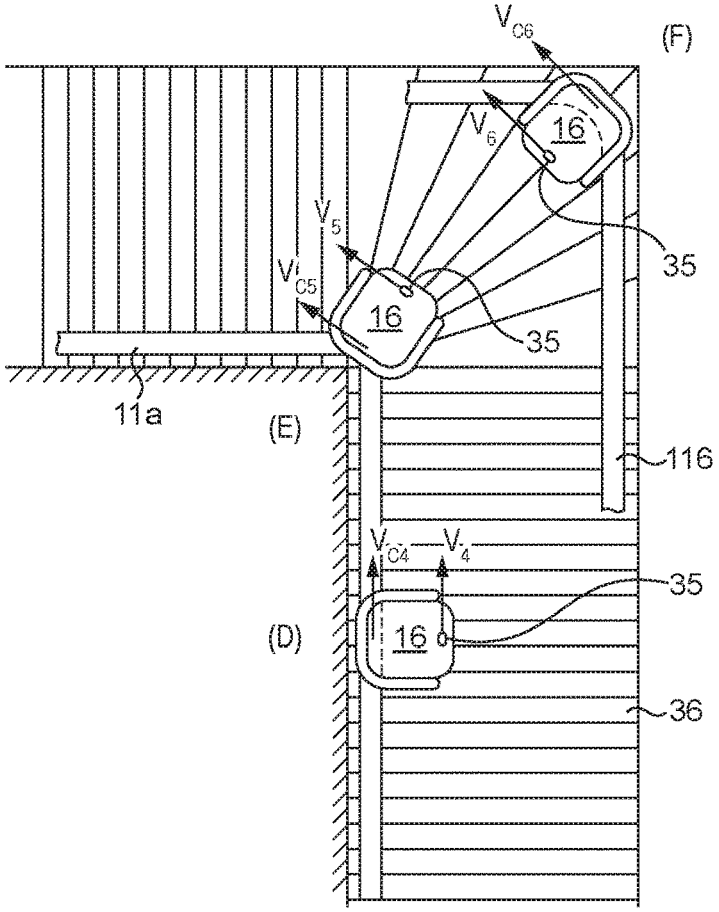
FIG. 4: shows a diagrammatical plan view of part of alternative rail mounting configurations, and a carriage at different positions on the rails shown.

Turning now to FIGS. 3 & 4, it will be appreciated that, as the stairlift carriage moves along the rail, the speed of the speed reference point 35 may vary relative to the speed of the carriage. In FIG. 3 a section of rail 11 is shown in elevation, the section including a positive transition bend at (A) and a negative transition bend at (C). It follows that, for the purposes of this disclosure, a positive transition bend is a bend in a vertical plane in which the angle of inclination of the rail increases when moving in an upward direction. A negative transition bend is a bend in a vertical plane in which the angle of inclination of the rail reduces when moving in an upward direction. Assuming a constant carriage speed, when the stairlift is moving along a straight section of rail, e.g. position (B) in FIG. 3, the reference point 35 will be moving at the same speed as the carriage i.e. V1=VC1. When the carriage is moving through a positive transition bend the reference point 35 moves through a shorter arc than the carriage and thus V2<VC2. When the carriage moves through a negative transition bend, the reference point 35 moves through a longer arc than the carriage and is thus speeded-up relative to the carriage. V3>VC3. It is thus apparent that the critical determining point or points for speed control are when the carriage is moving through a negative transition bend.

FIG. 4 illustrates alternative sections of rail 11 in a substantially horizontal plane. Rail section 11*a* is mounted on the inside of a staircase 36 and includes an inside bend at position (E) while rail section 11*b* is mounted on the outside of the staircase and includes an outside bend at position (F). It will be appreciated that, in reality, a stairlift installation will normally include either all inside or all outside bends and, providing there are no physical limitations to dictate otherwise, it is preferred to mount the rail on the inside edge of the staircase 36.

When the carriage is moving along a straight section of rail, as shown at position (D) in FIG. 4, V4=VC4. When the carriage is moving through the inside bend (E) as shown, the reference point 35 moves through a longer arc than the carriage and is thus speeded up relative to the carriage. V5>VCS.

When the carriage is moving through the outside bend (F) as shown, the reference point 35 moves through a shorter arc than the carriage and V6<VC6. Returning to FIGS. 1 & 2, physically the chair seat is offset from the carriage by an effective radius Rpiv above the rail/carriage pivot point. The seat itself is a certain distance Rsh above the rail/drive pinion interface. The reference point 35 on the chair surface is also cantilevered outwards from a vertical plane through the centerline of the rail by a distance Rscd.

When the chair is levelling upon the carriage traversing a transition curve in the rail (in reality, the chair maintaining level as the carriage displaces), the chair surface is assumed to be moving in a partial circle of radius Rsh while the leveling arm supporting the chair surface is also rotating about a radius of Rpiv.

A basic form of speed control according to the invention may be effected as follows:

Output signals from the 3-axis gyroscope are monitored by the ECU 30. Should the signals in either roll or yaw (generated by the carriage moving through a transition bend or horizontal bend respectively) exceed pre-determined thresholds, the ECU triggers the carriage drive motor 13 to slow down to a prescribed lower speed. The thresholds applied to the gyroscope outputs, and the carriage drive motor speeds, are set to ensure that the speed of the reference point 35 on the chair does not exceed the prescribed limit in both transition bends or horizontal bends.

The speed control method described above contemplates the carriage moving at two defined speeds only, a higher speed when traversing straight sections of rail and a lower speed when traversing bends. However the use of gyroscopes or similar electronic devices provides an opportunity to incorporate a more sophisticated reactive speed control system wherein the speed of the reference point 35 is continually calculated and the speed of the carriage drive motor 13 controlled to maintain a higher overall speed. To this end the speed of the reference point in rail bends is first established.

Simplified equations to describe the relative motion aligned to the stairlift rail for transition or roll curves is:

$$\text{Roll Component Speed}=((2\pi R\ \text{piv})\times(\acute{\text{Ø}}\ \text{gyro roll Sec}-1/360)\times(\cos\ \acute{\text{Ø}}\ \text{gravity}))+((2\pi(R\ \text{sh}-R\ \text{piv}))\times(\acute{\text{Ø}}\ \text{gyro roll Sec}-1/360))$$

Where Ǿ gyro roll Sec−1 is the carriage gyro output. Ǿ gravity is the carriage accelerometer angle versus gravity.

There is an extra term to describe the additional speed caused by inside/outside or yaw curves:

$$\text{Yaw Component Speed}=(2\pi\text{Rscd})\times(\acute{\text{Ø}}\ \text{gyro yaw Sec}-1/360)$$

So the complete equation is:

$$\text{Chair True Speed}=\text{Carriage Speed along rail}+((2\pi R\ \text{piv})\times(\acute{\text{Ø}}\ \text{gyro roll Sec}-1/360)\times(\cos\ \acute{\text{Ø}}\ \text{gravity}))+((2\pi(R\ \text{sh}-\text{Rpiv}))\times(\acute{\text{Ø}}\ \text{gyro roll Sec}-1/360))+(2\pi\text{Rscd})\times(\acute{\text{Ø}}\ \text{gyro yaw Sec}-1/36$$

This set of equations is simple enough for an on-board microcontroller to calculate in real time, based on the accelerometer and gyroscopic data from the chair and carriage. This means that at any point the chair seat speed can be calculated and the speed of the carriage motor 13 controlled, reactively, to maintain the speed of the reference point 35 at the desired level. Ignoring other limitations, this speed level may be the maximum permitted by the regulations.

It will be appreciated that the system for calculating true chair speed is entirely reactive and, accordingly, the carriage takes time to change speed when entering and exiting bends. To improve system efficiency and/or passenger comfort it is advantageous to include some form of pre-emptive speed adjustment around those positions on the rail where significant changes of speed occur. A further advantage of pre-emptively adjusting the speed is that excessive changes of speed, which could and invariably would arise in a purely reactive system attempting to maximize speed, can be removed.

These adjustments are made depending on the position of the carriage on the rail and may vary according to the nature and angle of the bend being negotiated. The pre-emptive adjustment facility is preferably 'self-learning', and compiles a set of speed settings (or change in speed settings) at particular positions along the rail which will ensure comfortable changes in speed while maintaining optimum overall speed.

In addition to the maximum speed setting described above, other factors influence speed setting and thus influence the overall time taken for the carriage to move up and down the rail.

Figure 5:
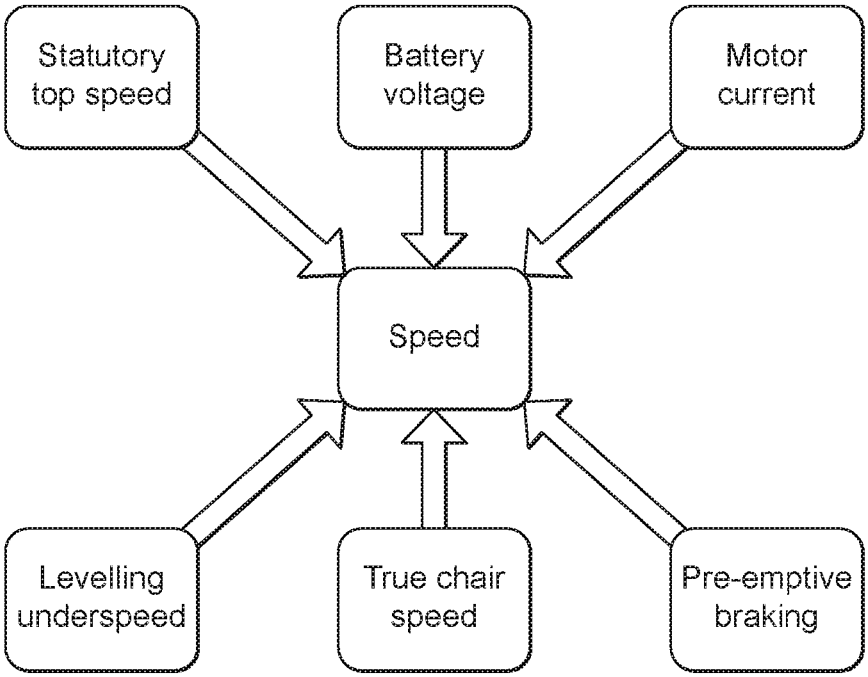
FIG. 5: shows a basic speed control diagram that includes elements of the invention.

Turning now to FIG. 5, the diagram shows various factors that are taken into account in the preferred implementation of the invention.

In this implementation the Statutory Top Speed is the maximum permissible speed at which the reference point on the chair may travel. As a first step the True Chair Speed is monitored in real time, in the manner described above, compared with the Statutory Top Speed and, if necessary adjustment made to the Carriage Speed to maintain True Chair Speed below the permissible maximum.

As indicated in FIG. 5, Battery Voltage is monitored and the Carriage Speed adjusted, if necessary, to maintain the battery voltage at or just above the permitted level. Battery Voltage will also vary as the carriage moves through a transition bend in the rail and the levelling motor operates to maintain the chair level. In this event the overall battery demand will inevitably reduce the battery capacity available to the main carriage motor. Motor Current is also monitored as an influence on carriage speed. Motor current will vary according to passenger weight and according to whether the carriage is moving up the rail or down the rail. Thus the ECU 30 can monitor the Motor Current in real time against a maximum permissible current draw and adjust Carriage Speed to maintain the Motor Current close to the limit and the speed as close as possible to the maximum permitted speed.

As described above, merely establishing maximum speeds by looking at True Chair Speed, has the potential to subject a passenger to uncomfortable speed changes as the carriage enters and exits bends. Accordingly Pre-emptive braking and acceleration may be applied. This function limits carriage speed against changes in chair speed due to the chair rotating about the carriage. It does this by monitoring the True Chair Speed during a journey, looking for rapid speed changes, commonly referred to as speed deltas. These speed deltas are stored in a memory bank against the positions on the rail at which they occurred. On the next run the ECU scans the memory bank for upcoming speed deltas and pre-emptively applies them as a speed limit, due to the fact that it takes time to change speed as acceleration/deceleration is limited. This allows the carriage to smoothly slow as it enters a bend and so maintain comfort for the user.

A further factor to be added into the determination of Carriage Speed is levelling under-speed. This takes into account the fact that as the carriage moves through a transition bend in the rail, the levelling motor 21 operates to maintain the chair level. If the carriage motor speed is not matched appropriately to the levelling motor speed, the chair could go 'off level' to an impermissible extent.

Figure 6:
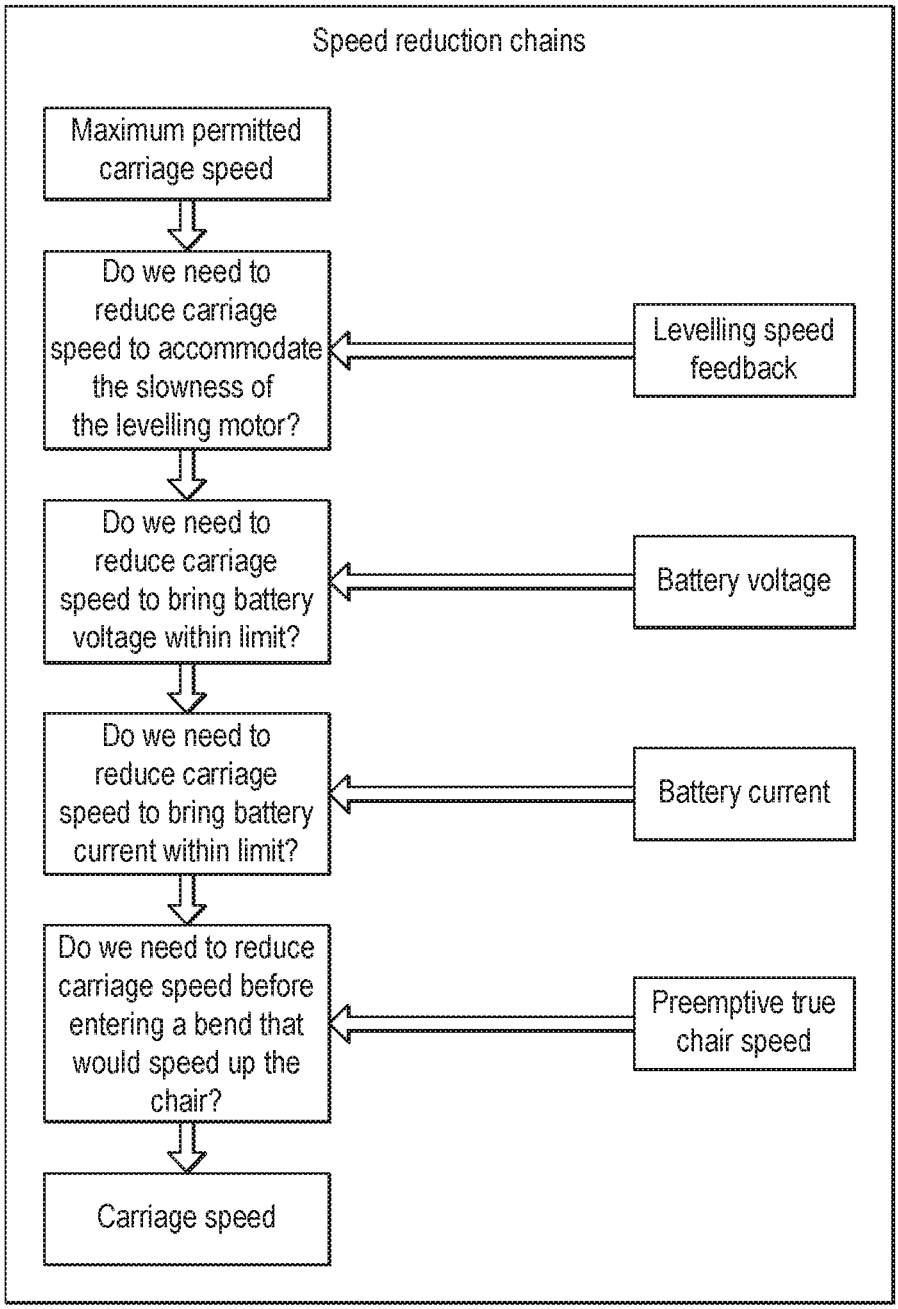
FIG. 6: shows, diagrammatically, how the various elements shown in FIG. 5 may be combined to generate a maximum carriage speed.

Turning now to FIG. 6, the various factors depicted in FIG. 5 are processed in the ECU 30 to provide a speed signal output to the carriage drive motor 13.

As a starting point a Maximum Permitted Carriage Speed is prescribed which may be the maximum speed permitted prescribed by regulation or may be another maximum speed programmed into the ECU. The first factor shown in FIG. 6 influencing this maximum speed is a feedback signal from the levelling motor, which signal may lead to a reduction in the speed of the carriage motor to ensure that the chair does not go off-level because of the relative slowness of the levelling motor as the carriage moves through a transition bend in the rail.

In the next step the ECU looks at Battery Voltage and, if necessary, adjusts the Maximum Permitted Carriage Speed to bring the battery voltage within permissible limits. Similarly the ECU looks at Battery Current and, if necessary, reduces Maximum Permitted Carriage Speed to bring the battery current within limit.

Finally the ECU looks at speed deltas as the carriage moves along the rail, in the manner described above, and adjusts the Maximum Permitted Carriage Speed to maintain speed deltas at levels which ensure passenger comfort.

The resultant output Carriage Speed can be applied to a conventional PID loop (not shown) to rotate the motor 13 at the speed demanded. In this case feedback control is provided by encoder 33.

It will thus be appreciated that the present invention provides a novel method and system for controlling stairlift speed in which the speed at any point along the rail is not set arbitrarily or to fixed limits but, rather, is determined in real time in response to a number of continually varying parameters. The system can continually adapt to these varying parameters to output varying speeds and thus allow a reduced overall journey time to be realized.

The invention claimed is:

1. A method of controlling the speed of a stairlift, the stairlift having:

a rail having at least one bend therein;

a carriage mounted on the rail;

an electric carriage motor operable to move the carriage along the rail;

at least one battery to power the electric carriage motor; and a chair mounted on the carriage, the method comprising:

generating a first signal representative of current drawn by the carriage drive motor;

generating a second signal representative of a voltage level in the at least one battery or the power draw from the battery;

generating one or more third signals representative of a speed of a reference point on the chair, the one or more third signals being combined with the first and second signals for controlling a speed of the electric carriage motor;

and controlling the speed of the electric carriage motor based on the combined first, second and one or more third signals.

2. The method according to claim 1, wherein the carriage is rotatable with respect to the chair at a relative angular velocity when the carriage rotates relative the chair, the method including generating a signal representative of the relative angular velocity between the carriage and the chair as the carriage moves through a transition bend in the rail.

3. The method according to claim 2, further including comparing the relative angular velocity with the speed of the electric carriage motor and, if necessary, adjusting the speed of the electric carriage motor to ensure that the chair is maintained substantially level.

4. The method according to claim 1, further including generating a signal representative of angular velocity of the carriage as the carriage moves through a horizontal bend in the rail.

5. The method according to claim 2, wherein measurement of the angular velocity of the carriage are effected using one more gyroscopes mounted in or on the carriage and/or the chair.

6. The method according to claim 5, wherein signals from the one or more gyroscopes are processed to establish the speed of a reference point on the chair.

7. The method according to claim 1, further comprising adjusting the speed of the carriage pre-emptively having regard to the position of the carriage on the rail.

8. The method according to claim 7, comprising learning and storing in a memory, acceptable speed changes at various positions on the rail.

9. A stairlift, including:

a rail having at least one bend therein;

a carriage mounted on the rail;

an electric carriage motor operable to move the carriage along the rail;

at least one battery to power the electric carriage drive motor; and a chair mounted on the carriage;

the stairlift further including a speed control facility configured to:

generate a first signal representative of current drawn by the electric carriage drive motor, generate a second signal representative of a voltage level in the at least battery or the power draw from the battery; and generate one or more third signals representative of the speed of a reference point on the chair, and to apply the one or more third signals, along with the first and second signals for controlling a speed of the carriage drive motor;

and controlling the speed of the electric carriage motor based on the combined first, second and one or more third signals.

10. The stairlift according to claim 9, wherein the speed control facility includes one or more gyroscopes mounted on or in the carriage and/or the chair to generate the first signal.

11. The stairlift according to claim 9, wherein the speed control facility includes a 3-axis gyroscope mounted in the carriage.

* * * * *